United States Patent [19]

Klygis et al.

[11] 4,300,681

[45] Nov. 17, 1981

[54] BOTTLE PACKAGE AND PACKAGING DEVICE

[75] Inventors: Mindaugas J. Klygis, Barrington; Edward L. Benno, Grayslake, both of Ill.

[73] Assignee: Illinois Tool Works Inc., Chicago, Ill.

[21] Appl. No.: 217,720

[22] Filed: Dec. 18, 1980

Related U.S. Application Data

[63] Continuation of Ser. No. 47,436, Jun. 11, 1979, abandoned.

[51] Int. Cl.[3] ..... A65D 65/00

[52] U.S. Cl. ..... 206/428; 206/432; 206/497

[58] Field of Search ..... 206/432, 427, 428, 497

[56] References Cited

U.S. PATENT DOCUMENTS

| | | | |
|---|---|---|---|
| 2,769,535 | 11/1956 | Bruce | 206/432 X |
| 3,062,373 | 11/1962 | Reynolds | 206/432 X |
| 3,404,505 | 10/1968 | Hohl et al. | 206/432 X |
| 3,951,259 | 4/1976 | Oglesbee | 206/427 X |
| 4,099,616 | 7/1978 | Klygis | 206/427 |

FOREIGN PATENT DOCUMENTS

| | | | |
|---|---|---|---|
| 2254208 | 7/1975 | France | 206/432 |

*Primary Examiner*—Joseph Man-Fu Moy
*Attorney, Agent, or Firm*—Thomas W. Buckman

[57] ABSTRACT

A packaging device and package created by the packaging device with a plurality of bottles. In a preferred embodiment a highly stretched tubular sleeve of resilient elastic plastic material is positioned about an array of bottles so that the upper extremity of the tube extends in a stretched condition over the shoulder of the bottles as well as substantially covering the cylindrical body portion of the bottles and exerts a resilient compressive force on all areas of contact between the sleeve and bottles to effectively unitize the package.

10 Claims, 7 Drawing Figures

BOTTLE PACKAGE AND PACKAGING DEVICE

This is a continuation of application Ser. No. 47,436, filed June 11, 1979 now abandoned.

SUMMARY AND BACKGROUND OF THE INVENTION

This invention relates generally to packaging devices for bottles and more particularly to bottle packages created by a highly stretched film packaging device.

Beverages are currently being packaged in various bottle-type containers. For example, a two-liter plastic bottle is becoming a popular beverage container. Such bottles are understandably quite heavy and any multi-packaging device for these containers must be designed to be reliable and easily handled.

There have been many prior art suggestions for multi-packages for such containers. For example, a clip device which snaps onto the tops or adjacent to the tops of the bottles creates a package and handle for such a package. However, such single contact clips have lack of stability and allow the bottles to swing freely from the top engaging point. Other prior art efforts incorporate a bag device which is slightly stretched around an array of bottles secured at either or both the top or bottom. Other efforts to multi-package bottles in general include the use of a plastic band surrounding the bodies of the containers in an array with an additional resilient plastic device secured to the tops of the bottles exerting a force tending to pull the tops together.

Past attempts to design and/or produce a multi-package for bottles have been generally unsatisfactory because of one or more of the following reasons: The package may be too expensive, the package created is unstable and difficult to handle, the package does not provide proper protection for the bottles, be they made of glass or plastic, the package is not conductive to high speed application techniques, the package is unreliable particularly as it relates to large bottles.

The subject invention represents a unique solution to problems of multi-packaging bottles and particularly overcomes the disadvantages of prior art attempts.

The package of this invention basically utilizes a thin film, tubular device of uniform diameter which is uniquely designed to be positioned around a plurality of bottle-like containers and secure them relative to one another and to the tubular device by exerting a resilient compressive force on all areas of the bottles contacted by the device. The packaging device of this invention has particular utility when used with bottles which have a generally cylindrical body portion leading to a shoulder portion of gradually decreasing diameter to the diameter of the neck of the bottle. The tubular device described herein encircles substantially all of the body portion and at least a part of the shoulder portion of such bottles.

The tubular device or band is of a stretchable elastic plastic material, such as polyethylene or polypropylene, and because of the unique design of the package and device, can be of a very thin gauge, such as 2–3 mils. The unstretched circumference of the tube is substantially less than the circumference of the array of bottles at all circumferential areas that are encircled by the tube.

In accordance with a further aspect of the invention, an array of plastic bottles packaged with a highly stretched tube device produces substantially planar flat surface areas in abutting sidewall regions. This construction substantially enhances the stability of the package produced.

Other embodiments of the invention may include a rigid handle interposed between the necks of the bottles, but exerting no substantial outward force on the bottles.

It is, therefore, an object of the invention to provide a new and improved package-making device and package for bottles.

A further object of the invention is the creation of a package which is stable, efficient and easy to handle for practically any reasonable sized bottle.

A further advantage of this invention is the creation of a multipackage which is designed to provide a substantially unitized array of bottles with a packaging device which may be easily removed.

Other objects and features of the invention will be apparent upon perusal of the hereinafter following detailed description in conjunction with the drawings.

DETAILED DESCRIPTION OF THE PREFERRED EMBODIMENTS

Figure 1:
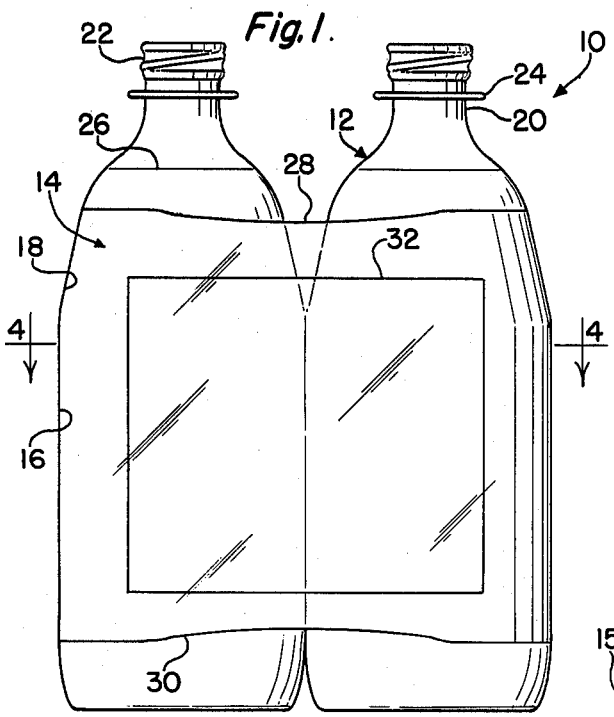
FIG. 1 is a side elevational view of a package made in accordance with the invention.
Figure 2:
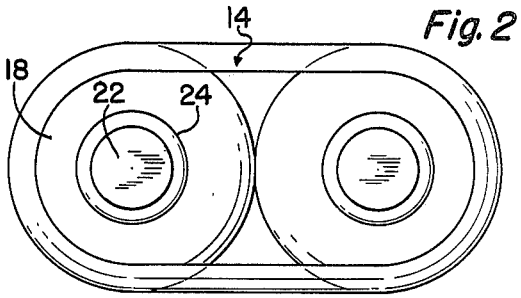
FIG. 2 is a top plan view of the package shown in FIG. 1.

In the preferred embodiment of the package shown in FIGS. 1 and 2, a package 10 comprises a pair of substantially identical bottles 12, surrounded by a stretched tube or band device 14.

As will be discussed later herein, the package and package making device of this invention has particular utility with plastic bottles and more specifically with plastic bottles of the relatively large, two-liter size. However, it should be noted that all aspects of the invention are not limited to packaging of two bottles nor limited to the packaging of a large plastic bottle.

The bottles shown in FIG. 1 are typical two-liter bottles made from deformable plastic including liquid contents 26 and include a generally cylindrical body portion 16, extending over a major axial dimension of the bottle. This body section leads into a shoulder portion 18 of gradually diminishing circumferential diameter which merges into a greatly reduced diameter neck region 20 and cap region 22. The bottle also will include an annular flange 24 in the neck region directly below the cap 22.

Figure 3:
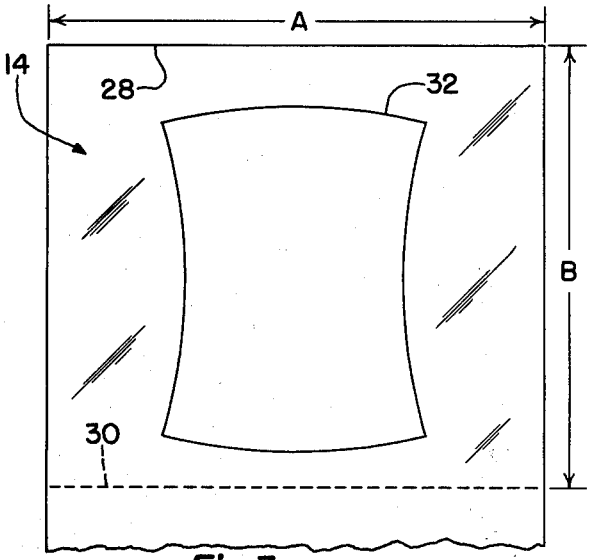
FIG. 3 is a plan view of the packaging device in strip form used to produce the package of FIG. 1.

The tube device 14 which forms an important part of the package 10 is of uniform diameter and as shown in FIG. 3 its lay-flat width dimension "A" is such that the circumferential diameter of the tube is substantially less than the circumferential dimension about the array of bottles in the region of the body portions 16. The circumferential diameter of device 14 is also less than the array in the region of shoulder portions 18. Such a dimensional relationship ensures that the array of bottles is tightly unitized as a package.

The tube device 14 may be created from an endless strip of tubular material as depicted in FIG. 3. Upper and lower margins 28 and 30 forming the proper length of tube device 14 are formed by properly metered cuts in the tube strip.

While the tube device 14 is in a highly stretched condition in the finished package as noted by the deformation of upper margin 28 and lower margin 30, it should be understood that a clearly identifiable and undeformed label or legend can be created by distortion printing on each and every one of the packaging devices 14. With such printing, the amount of lateral and longitudinal deformation of the margins of a label, as shown by upper margin 32 of an illustrative label, will be straight while the margins of the tube are deformed. Note in FIG. 1 that the upper and lower edges of the label 32 are substantially straight while the upper and lower edges 28 and 30 are curved somewhat as a catenary curve. In the printing of the label 32, the upper and lower edges are correspondingly buldged upwardly and downwardly as shown in FIG. 3.

As noted in FIGS. 1 and 2, an important aspect of the invention is the axial extent of the tube as it relates to the bottles which it encircles. The tube is dimensioned so that it has a length dimension "B" sufficient to cover all or most of the cylindrical body portion 16 and at least part of the shoulder portion 18. It has been found that this configuration of a package in highly stretched condition creates a package of high integrity necessary with containers of this type in a multi-package. Movement of the bottles relative to each other and to the tube device is minimized and handling of the package thus formed is facilitated when the upper regions of the bottles are tightly compressed by the same device which is tightly compressing a substantial portion of the body of the bottles.

Figure 5:
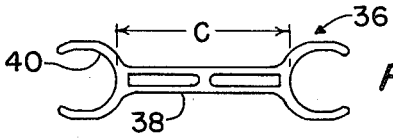
FIG. 5 is a top plan view of a handle member that may be used with this invention.
Figure 6:
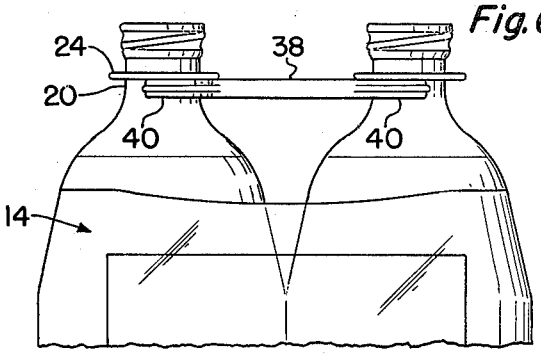
FIG. 6 is a partial elevational view, similar to that in FIG. 1., showing the handle member of FIG. 5 incorporated in the package.

While a package of two such containers shown in FIGS. 1 and 2 may be adequately handled without a secondary carrying device, it may be desirable in certain circumstances to have a discrete handle. With this in mind, a handle device, such as shown in FIGS. 5 and 6, has been found to be acceptable. The device 36 is of a rigid plastic material and includes a central strut portion 38 terminating in a pair of yoke-like or C-shaped bottle neck receiving openings 40. The dimension "C" between the radial innermost regions of the yoke-like members 40 is not appreciably greater than and preferably equal to or less than the dimension between opposed surface regions of the necks 40 when packaged by the device 14. With such a configuration, the handle is positioned below the flanges 24 and exerts substantially no outward pressure on the package. The abutment of the C-shaped regions against the undersurface of the flange 24 creates a highly stable and functional package for its intended purposes. The arms of the C-shaped regions are shown to extend a peripheral distance slightly greater than 180° creating a slightly constricted mouth which permits the neck of the bottles to snap into the extremities. With such a configuration, the handle 36 could serve as a means to return or carry the empty bottles.

Figure 4:
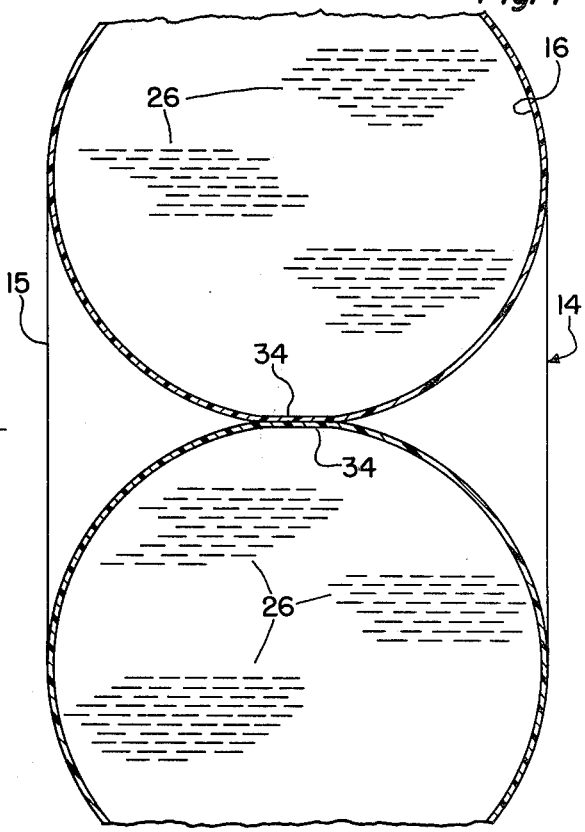
FIG. 4 is an enlarged cross-sectional view of the package as taken along lines 4—4 of FIG. 1.

Turning to FIG. 4, a further important aspect of the invention will be described. When such a highly stretched tube device 14 is used about a bottle which has a deformable plastic sidewall, the abutting regions of the bottles are deformed to form conforming two-dimensional planar surface areas 34. These flats add further stability to the package in that rotation about the axes of the bottles and relative to the sleeve device are prevented and relative rocking of the bottles in other directions are prevented. This is to be distinguished from the line or point contact between bottles in prior art packates. It should be understood that these planar surface areas 34 need not be continuous throughout the extent of the body 16, but depending upon the actual configuration of the bottle, may either be spaced planar sections, a single planar section or continuous planar sections. Even an all plastic bottle, filled with liquid and sealed, will exhibit this self-stabilizing feature.

Figure 7:
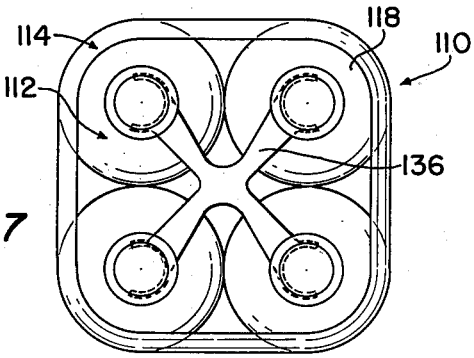
FIG. 7 is a top plan view of a package made in accordance with the invention showing four bottles.

As noted above, the invention need not be limited to packaging two bottles but can package any multiple or any type of array of bottles. For example, in FIG. 7, a top view of a package 110 of four bottles 112 is shown using a sleeve 114 which encircles the cylindrical portions of the bottles. In keeping with the invention, the upper regions of the tube device 114 also aggressively encircles portions of the shoulders 118 of the bottles. A single handle device 136 similar to handle 36 may be used in such a package if desired. The four-pack shown in FIG. 7 is merely illustrative of the fact the invention can be adapted for use in any variety of arrays, such as 2, 3, 4, 6, or any other reasonable multiple.

An important aspect of the invention is the design of the tubular member 14 with the proper characteristics so as to function as a unitizing member. A highly stretched condition is important in the utilization of this invention to the extent that the tube 14 has a width dimension "A" which creates a circumferential dimension at least 20% smaller than the circumferential dimension of the array which is to be encircled by the tubular material. As an example, the tubular device 14 of FIG. 3 may have a lay-flat dimension "A" of 9 inches where the two bottles to be packaged each have approximately a diameter of 4½ inches. Thus, it is apparent that even in the shoulder region of each bottle, the tubular member is substantially stretched. The length dimension "B" of the example is approximately 9 inches which is greater than the axial extent of the body region 16 of known two-liter plastic bottles.

In addition to the dimensions of the tube, the actual structure of the film itself is important to the invention. The tubular device 14 must be biaxially oriented for proper strength since it is to be highly stretched and remain in a highly stretched yet resilient condition in the package. A tube device 14 which has been oriented in the lateral direction or along dimension "A", as well as in the length dimension or along dimension "B", has been found to be desirable for an attractive, stable package. The attractiveness, strength and other characteristics desired in the device have been enhanced when the degree of molecular orientation in the direction of the length dimension "B" is at least equal to and not substantially less than the degree of molecular orientation in the direction of width "A". Suitable orientation patterns may be created by a proper design of the blow-up ratio of the plastic in the blowing of the tube relative to speed of draw and winding of the tubular material as it is blown and/or a post blow-up rolling or drawing. Many combinations of such manufacturing parameters are available in the creation of the necessary molecular orientation pattern to produce the necessary strength and resiliency of the plastic tube in the package.

When the package is created in accordance with this invention, the tube device 14 can be rapidly and efficiently removed by a simple puncturing step as with a finger. The puncture force applied to the tube in regions, such as 15 shown in FIG. 4, which do not contact the bottles, followed by a force either upwardly or downwardly will easily strip the device from the array.

While the use of the oriented tube device of FIG. 3 is primarily described herein as a device for packaging a plurality of like bottles, it may find particular utility as a tight fitting, durable label band for a single container. Such a highly stretched, oriented, resilient band can be adapted for high speed applications to containers to produce tighter more attractive labels than presently known in the art.

Having thus described the invention, it should be understood that many changes could be made in the described embodiments by one skilled in the art and still come within the spirit and scope of the claims.

We claim:

1. A bottle package comprising a plurality of substantially identical bottles and a band, each of said bottles being shaped with a lower body section, a neck section and a shoulder portion extending between said body section and said neck section, said shoulder portion being generally frusto-conical of a progressively reducing circumferential dimension in an upward direction, and a cap section on the upper end of said neck section, said band comprising a tubular section of a resilient elastic plastics film material of less than approximately four mils thickness, said tubular section prior to cooperation with said bottles comprising a flexible lay-flat tubular section of equal circumferential dimension longitudinally thereof between the open upper and lower ends thereof, said plurality of bottles arranged in a predetermined array in upstanding and side-by-side section contact, the array having predetermined circumferential dimensions in regions of the body sections, shoulder portions, neck sections and cap section of the bottles comprising the array, said equal circumferential dimension being greater than the greatest predetermined circumferential dimension of the array of bottles about any area of the cap sections and upper neck sections above said shoulder portions, said equal circumferential dimension of the tubular section in the unstretched condition further being substantially less than the smallest predetermined circumferential dimension of the array of bottles about any area of said body sections and at least the lower regions of said shoulder portions, said tubular section prior to cooperation with said bottles further having a length no greater than the vertical dimension between the bottom of one of said bottles and the upper end of said shoulder portion thereof and a length substantially greater than the vertical dimension between the bottom of one of said bottles and the upper end of said body section thereof, the upper edge extremity of the tubular section being located above the intersection of the shoulder portion and the cylindrical body section and said band being in highly stretched circumferential application about said array of bottles with the lower end of said band adjacent the bottom of said array and with the upper end on said shoulder portions of said bottles comprising the array, the tubular section creating an array conforming and unitizing member which is highly stretched about the cylindrical body sections as well as about the shoulder portions with the amount of stretch being less at the shoulder portions than at the body portions, said plastics material of said tubular section being bi-axially oriented with substantial molecular orientation in both the transverse and longitudinal directions of said tubular sections and in cooperation with said thickness of material producing a resiliency and elasticity causing said band to firmly and resiliently conform to the configuration of the bottle surface areas engaged by said tubular section.

2. The bottle package of claim 1, wherein the number of substantially identical bottles packaged thereby is two.

3. The bottle package of claim 1, wherein the number of substantially identical bottles packaged thereby is more than two.

4. The bottle package of claim 2, wherein the neck section includes a radially enlarged flange directly below the cap section, a rigid handle interposed between the neck section of the bottles comprising a central strut and generally C-shaped neck receiving extremities, the neck receiving extremities positioned beneath the radially enlarged flange on associated bottles and adapted to abut against the lower surfaces of said flanges upon application of an upwardly directed carrying force to said central strut.

5. The bottle package of claim 4, wherein the handle has a predetermined axial dimension between innermost surfaces of said C-shaped extremities, said predetermined axial dimension being not substantially greater than the distance between opposed neck surfaces directly beneath the flanges of said bottles so that the handle does not exert appreciable forces on the bottles tending to force them apart when packaged by said resilient elastic plastic tube material.

6. A stable bottle multi-package comprising a plurality of bottles arranged in a predetermined, side-by-side, upstanding array, a sleeve member encircling said array, each of said bottles being filled with a liquid product and sealed, each of said bottles having a lower, generally cylindrical body section comprising a major axial extent of said bottles and an upper neck and shoulder portion, the shoulder portion progressively decreasing in circumferential dimension from the body section to the neck portion, at least a substantial vertical section of the body section of each of said bottles including deformable plastic wall sections, the sleeve formed of a resilient, elastic, plastic tubular material of a thickness substantially less than the wall thickness of the bottles and length at least as great as a substantial portion of the axial extent of the body sections, said sleeve having an initial, unstretched, circumferential dimension substantially smaller than a circumferential dimension of the array taken about the body sections of the plurality of bottles, wherein the thickness of the tubular material is substantially uniform and less than four mils and the unstretched circumferential dimension of said material is at least 20% smaller than the primary circumferential dimension of the array which is to be encircled by the tubular material, said predetermined side-by-side upstanding array of said bottles further comprising cooperating surface engagement regions of said substantial vertical section of deformable plastic wall sections of adjacent bottles in said array, and the sleeve member positioned to encircle said array over the substantial portion of the body sections and exerting substantial pressure on the regions of the bottles which are contacted by said sleeve ensuring that said cooperating surface engagement regions of the deformable plastic wall sections of adjacent bottles in the array are deformed into mating, cooperating generally planar surface areas, whereby the deformed cooperating surface areas further stabilize the package thus formed.

7. The bottle multi-package of claim 6, wherein the array consists of two deformable plastic material bottles.

8. In a unitized package, a tube for stretched application circumferentially about at least substantial body portions of a plurality of bottles in side-by-side array, at least said substantial body portions of said bottles being substantially circular in horizontal cross section, said tube comprising a section of seamless, lay-flat, resilient, elastic plastics film material tubing of uniform diameter and of a thickness less than four mils which is substantially biaxially oriented substantially in the directions of the length and width of the tube, said tube having a length at least as great as the lay-flat width thereof and the circumferential dimension of said tube in unstretched condition being at least 30% smaller than the maximum circumferential dimension of said array in the region of said substantial body portions of said bottles intended to be encircled by said tube upon stretched application, said tube having a distorted legend thereon intended to at least span said substantial body portions of said bottles in said array without substantial contact between the legend and bottles between adjacent points of contact between the tube and said bottles, one side of two adjacent bottles in said array when said tube is in stretched application about at least substantial body portions of said plurality of bottles, the degree of distortion of said distorted legend being related to the degree and pattern of stretch applied to said tube and to the pattern of biaxial orientation in said tube so that the distortion is substantially removed in said legend upon stretched circumferential application of said tube circumferentially about at least substantial body portions of said plurality of bottles in side-by-side array with said legend uncontactingly spanning a predetermined region of said substantial body portions.

9. The tube of claim 8, wherein the object intended to be encircled is an array of a plurality of substantially identical bottles and the length of said tube being substantially greater than the length of the body portion of said bottles and less than the height of said bottles.

10. The tube of claim 8, which has a molecular orientation pattern designed particularly to create a package in which high lateral compressive forces are produced between the bottles.

* * * * *